US010352557B2

(12) United States Patent
Huang et al.

(10) Patent No.: US 10,352,557 B2
(45) Date of Patent: Jul. 16, 2019

(54) BURNER FOR GAS APPARATUS

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW); Wei-Long Chen, Taichung (TW); Kuan-Chou Lin, Taichung (TW); Tang-Yuan Luo, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 249 days.

(21) Appl. No.: 15/382,422

(22) Filed: Dec. 16, 2016

(65) Prior Publication Data

US 2018/0087771 A1 Mar. 29, 2018

(30) Foreign Application Priority Data

Sep. 26, 2016 (TW) ..... 105131035 A

(51) Int. Cl.
*F23D 14/62* (2006.01)
*F23D 14/02* (2006.01)
(Continued)

(52) U.S. Cl.
CPC ..... *F23D 14/02* (2013.01); *F23D 14/04* (2013.01); *F23D 14/62* (2013.01); *F23D 14/70* (2013.01);
(Continued)

(58) Field of Classification Search
CPC ..... F23D 14/02; F23D 14/04; F23D 14/16; F23D 14/70
(Continued)

(56) References Cited

U.S. PATENT DOCUMENTS 1,368,120 A 2/1921 Cole
1,563,050 A * 11/1925 Thompson ..... B05B 1/14 239/553
(Continued)

FOREIGN PATENT DOCUMENTS

DE 19958340 A1 6/2001
EP 0028102 A2 5/1981
(Continued)

OTHER PUBLICATIONS

Examination Report for TW105131035, dated Jun. 2, 2017, Total of 8 pages.
(Continued)

*Primary Examiner* — Vivek K Shirsat
(74) *Attorney, Agent, or Firm* — Lynette Wylie; Apex Juris, PLLC.

(57) ABSTRACT

A burner includes a base and a combustion tray, wherein the base has an inlet pipe and two horn-shaped tubes. The horn-shaped tubes are connected to opposite sides of the inlet pipe, wherein each of the horn-shaped tubes respectively has a first section. A length of the first sections is no less than an inner diameter of the inlet pipe at where the horn-shaped tubes are connected to. The combustion tray is engaged with the base, and communicates with the horn-shaped tubes. Whereby, gas and air could be fully mixed while flowing through each of the first sections. The symmetrical horn-shaped tubes could direct the airflow to the combustion tray, where the airflow could be outputted from flame vents of the combustion tray, whereby to generate more even flame, and to enhance the heating efficiency.

11 Claims, 12 Drawing Sheets

(51) Int. Cl.
*F23D 14/04* (2006.01)
*F23D 14/70* (2006.01)

(52) U.S. Cl.
CPC .. *F23D 2203/007* (2013.01); *F23D 2203/102* (2013.01); *F23D 2203/106* (2013.01); *F23D 2203/1017* (2013.01); *F23D 2203/1026* (2013.01); *F23D 2212/201* (2013.01); *F23D 2900/00003* (2013.01)

(58) Field of Classification Search
USPC ..... 431/354, 178, 179, 326–329
See application file for complete search history.

(56) References Cited

U.S. PATENT DOCUMENTS 3,122,197 A * 2/1964 Saponara ..... F23D 14/145 431/329
6,062,849 A * 5/2000 Polidoro ..... F23D 14/10 431/114
6,916,175 B2 * 7/2005 Cho ..... F23D 14/105 431/285
2011/0306000 A1 * 12/2011 Huang ..... F23D 14/26 431/350

FOREIGN PATENT DOCUMENTS

FR 2220045 A1 9/1974
FR 2708716 A1 2/1995

OTHER PUBLICATIONS

Search Report for TW105131035, dated May 31, 2017, Total of 1 page.
English Abstract for DE19958340, Total of 1 page.
English Abstract for FR2708716, Total of 1 page.

* cited by examiner

BURNER FOR GAS APPARATUS

BACKGROUND OF THE INVENTION

1. Technical Field

The present invention relates to a heating device, and more particularly to a burner, which could fully mix gas and air for a more even burning performance.

2. Description of Related Art

A conventional burner 1 is illustrated in FIG. 1, including a base 2 and a combustion tray 3. The base 2 is formed by two symmetrical panels which are made by stamping, wherein each of the panels is designed to have a specific shape, so that the base 2 has a U-shaped inlet pipe 2*a* horizontally formed therein. One end of the inlet pipe 2*a* is an inlet 2*b* adapted to accept gas and air. The combustion tray 3 is long in shape, and is provided above the base 2. A plurality of flame vents 3*a* are provided on the combustion tray 3. The flame vents 3*a* are arranged in a longitudinal direction of the combustion tray 3, and communicate with the inlet pipe 2*a*. By igniting the mixed gas and air which passes through the inlet pipe 2*a* and flows out through the flame vents 3*a* of the combustion tray 3, flames can be created.

However, the inlet pipe 2*a* of the base 2 has a turn in it, and gradually becomes narrower after passing the turn. Therefore, most of the airflow in the inlet pipe 2*a* turns left after bumping into the turning section, and then tends to flow out through the flame vents 3*a* on the left side of the combustion tray 3. As a result, the amount of the mixed gas and air flowing out from the flame vents 3*a* gradually decreases from left to right.

The relationship between the mass flow and the position of each of the flame vents 3*a* is illustrated in FIG. 2, wherein the flame vents 3*a* are numbered as 01-44 from left to right in sequence. It can be clearly seen that the mass flow of the flame vents 3*a* decreases from left to right obviously. In other words, the flame vents 3*a* with lower mass flow (such as the flame vent #34) would have smaller flame comparing to the flame vents 3*a* with higher mass flow (such as the flame vent #04). Therefore, the flame created by the burner 1 shows a gradual decrease from left to right, leading to an uneven heating performance, which reduces the heating efficiency.

BRIEF SUMMARY OF THE INVENTION

In view of the above, the primary objective of the present invention is to provide a burner, which could send out the airflow through the flame vents of the combustion tray in a more even way.

To achieve the objective of the present invention, the present invention provides a burner, which includes a base and a combustion tray. The base includes an inlet pipe and two horn-shaped tubes, wherein each of which has a first section and a second section connected to the first section in a substantially perpendicular manner. Each of the first sections is connected to the inlet pipe. A length of each of the first sections is greater than or equal to an inner diameter of the inlet pipe at where the first sections are connected to. Each of the second sections is bent to extend toward the other second section, and communicates with at least one air passage, wherein the air passage which communicates with one of the second sections also communicates with the air passage which communicates with the other one of the second sections. The combustion tray is provided on the base, wherein the combustion tray includes a flame plate located above the air passages communicating with the second sections of the horn-shaped tubes. The flame plate has a plurality of first flame vents communicating with the air passages.

With the aforementioned design, the symmetrical horn-shaped tubes could direct the airflow to the combustion tray, wherein the airflow would pass through the flame vents in a more even distributed manner, whereby to provide a more even heating performance as well. Furthermore, since the length of each of the first sections is greater than or equal to the inner diameter of the inlet pipe at where between the horn-shaped tubes, gas and air could be mixed more evenly, enhancing the heating efficiency.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 3:
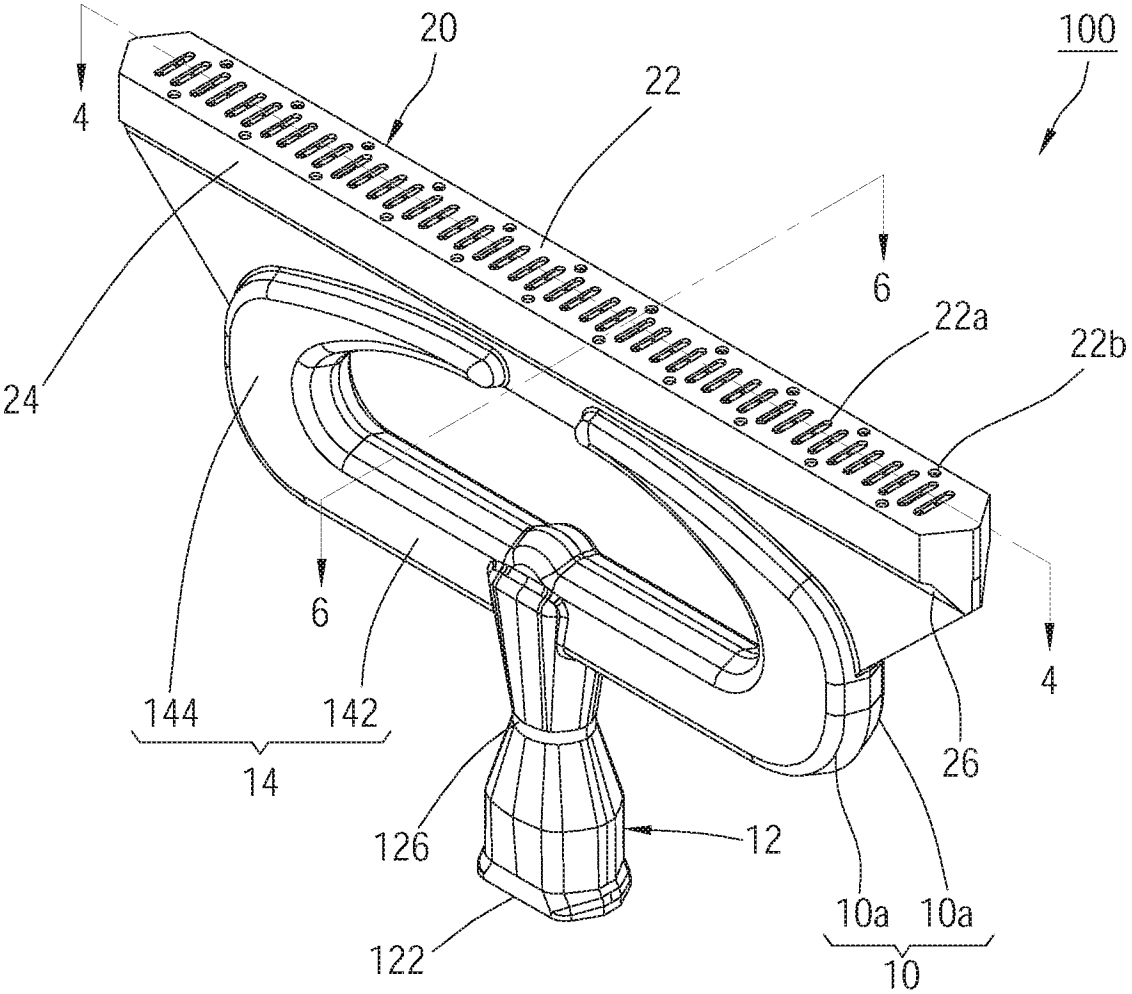
FIG. 3 is a perspective view of a first embodiment of the present invention.
Figure 4:
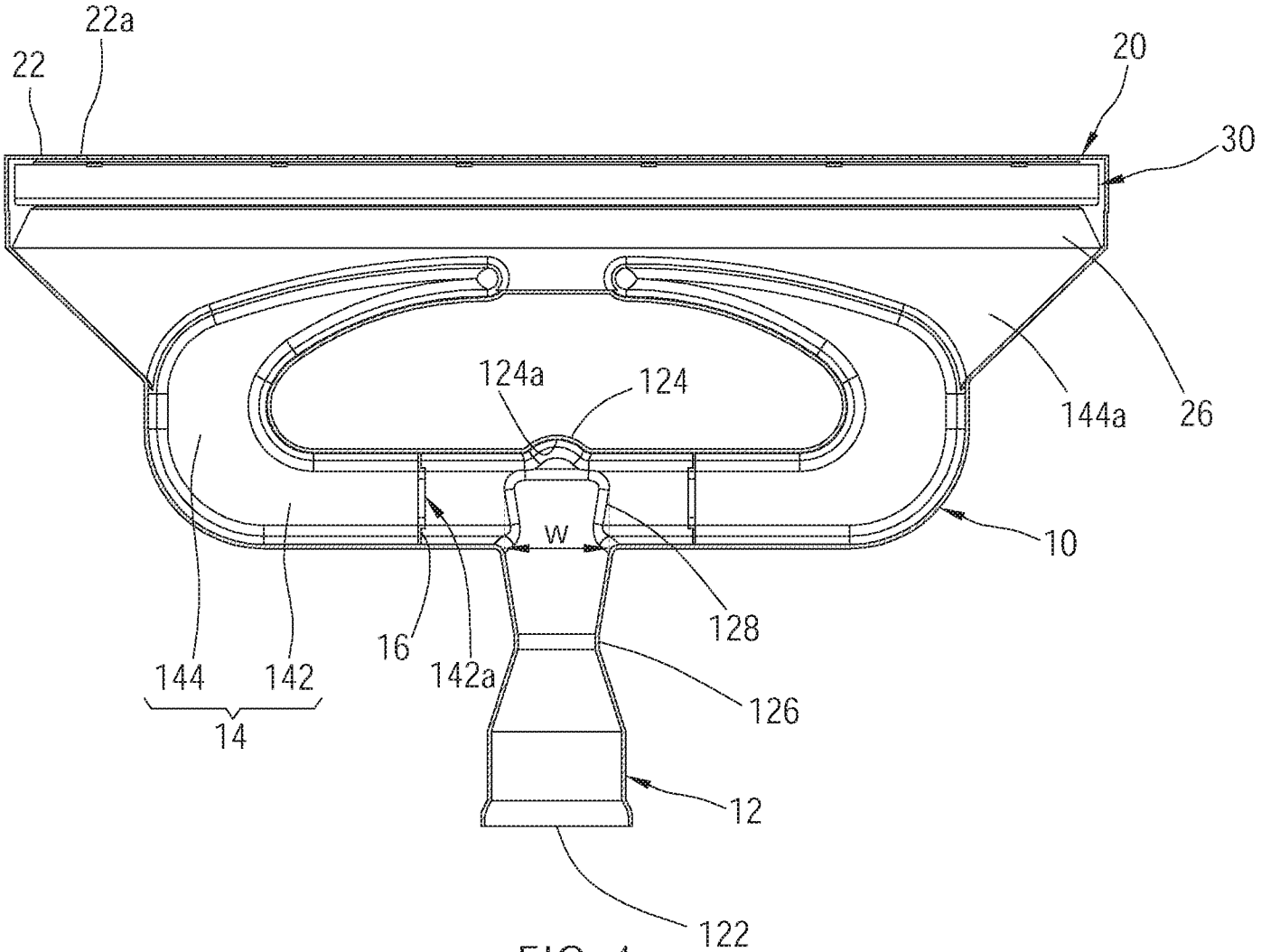
FIG. 4 is a sectional view along the 4-4 line in FIG. 3.
Figure 5:
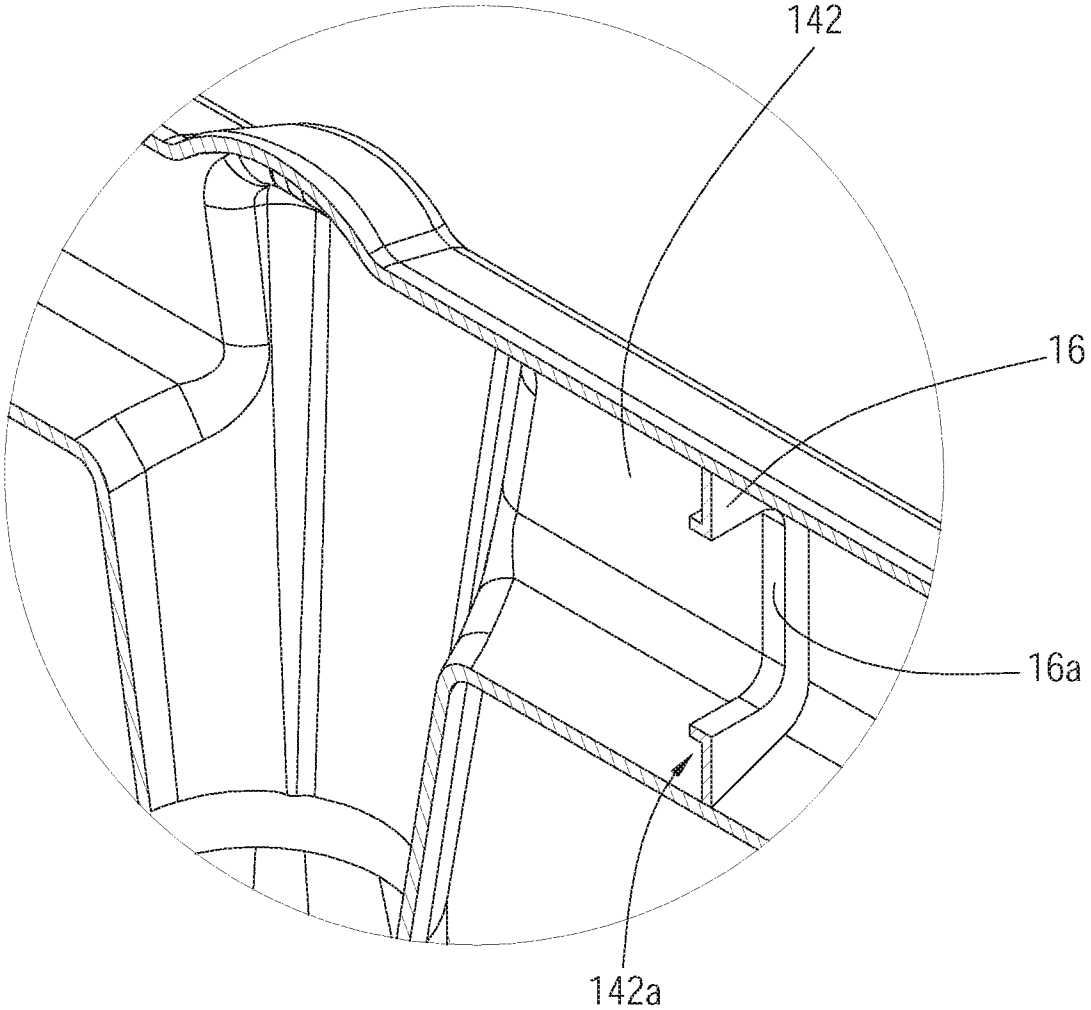
FIG. 5 is a partial sectional perspective view, showing parts of the first embodiment.

A burner 100 of a first embodiment of the present invention is illustrated in FIG. 3 to FIG. 5, including a base 10, a combustion tray 20, and a flow splitter 30.

The base 10 is formed by two symmetrical panels 10*a*, which are made by stamping, and are designed to have a specific shape so that the base has an inlet pipe 12 and two horn-shaped tubes 14 formed therein. The inlet pipe 12 has an inlet end 122 and a closed end 124, wherein the inlet end 122 is adapted to accept gas and air. The inlet pipe 12 has a curved surface 124*a* recessed into an inner wall of the closed end 124, wherein the curved surface 124*a* recesses in a direction opposite to the inlet end 122. The curved surface 124*a* would be helpful to mix gas and air more evenly. In addition, a reduced section 126 is provided between the inlet end 122 and the closed end 124 of the inlet pipe 12, wherein an inner diameter of the reduced section 126 is less than an inner diameter of anywhere else of the inlet pipe 12. In other words, the reduced section 126 is the narrowest section of the inlet pipe 12. The inlet pipe 12 further has two lateral openings 128 located between the closed end 124 and the reduced section 126, wherein each of the lateral openings 128 respectively communicates with one of the horn-shaped tubes 14.

Figure 1:
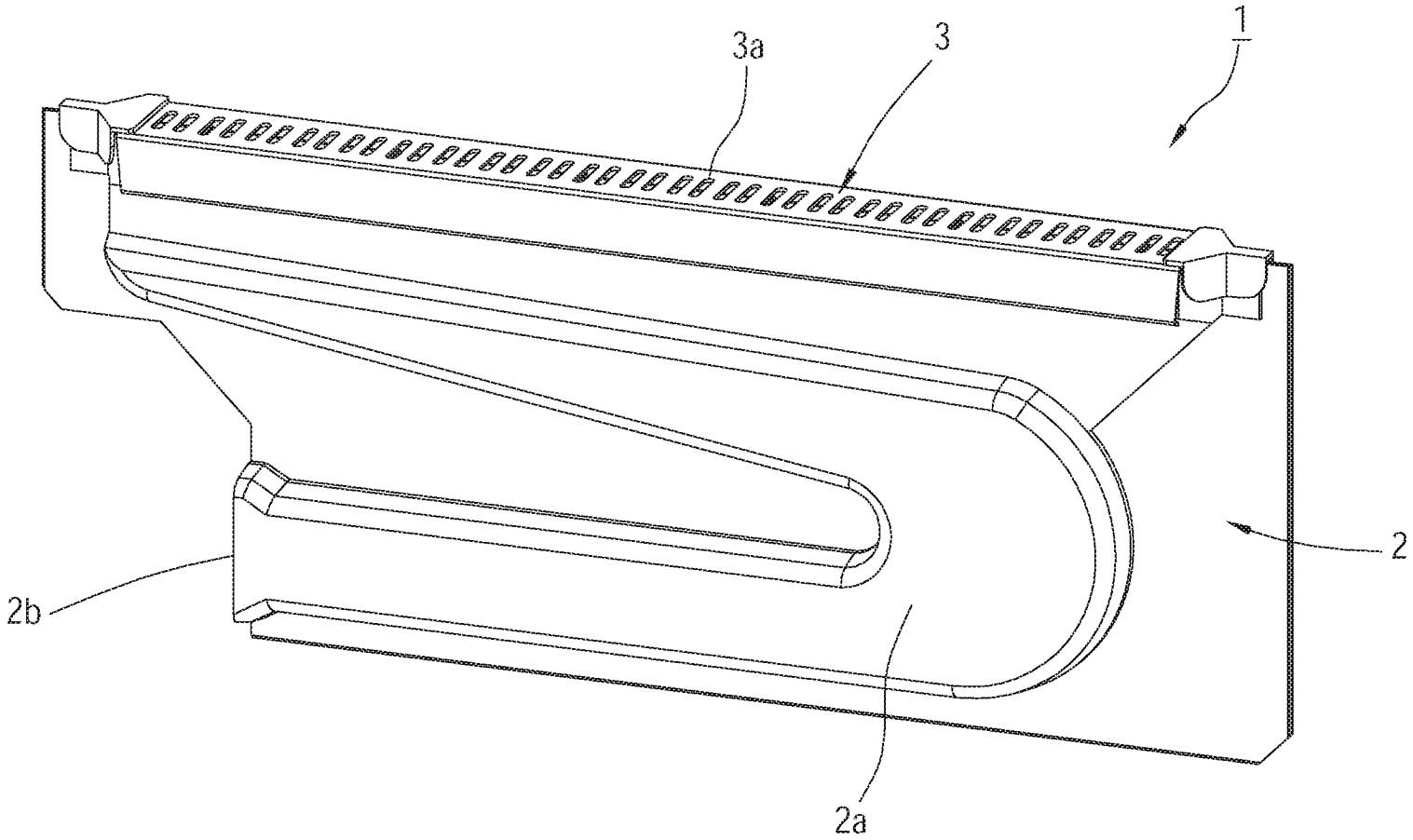
FIG. 1 (PRIOR ART)
FIG. 1 is a perspective view of a conventional burner.
Figure 2:
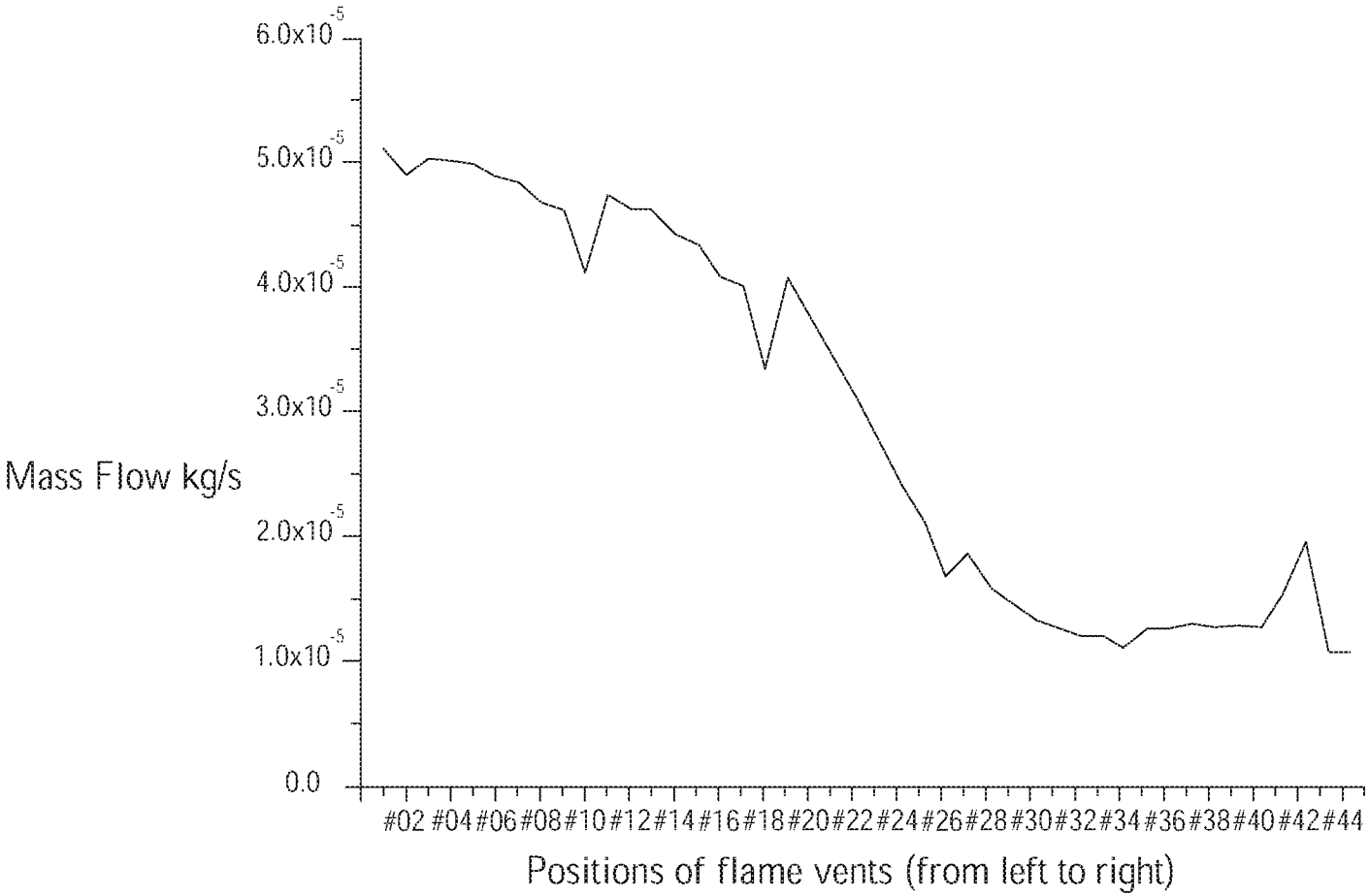
FIG. 2 (PRIOR ART)
FIG. 2 is a relationship chart, showing the relationship between the mass flow and the positions of the flame vents of the conventional burner.

Each of the horn-shaped tubes 14 respectively has a first section 142 and a second section 144, wherein the first section 142 is connected to the inlet pipe 12, and communicates with one of the lateral openings 128, while the second section 144 is connected to the first section 142 in a direction substantially perpendicular to the first section 142. A length of the first section 142 is greater than or equal to the inner diameter of the inlet pipe 12 at where between the horn-shaped tubes 14 (i.e., the width w shown in FIG. 2). In other words, the length of the first section 142 is greater than or equal to the distance between the lateral openings 128. Each of the second sections 144 is bent to extend toward the other second section 144, and communicates with at least one air passage 144*a*, wherein the air passage 144*a* communicating with one of the second sections 144 also communicates with the air passage 144*a* communicating with the other one of the second sections 144. As shown in FIG. 5, each of the first sections 142 respectively has an indented section 142*a*, wherein a cross-sectional area thereof is 70 percent to 80 percent of an average cross-sectional area of other portions of the first section 142. More specifically, the cross-sectional area of each of the indented sections 142*a* is a minimum cross-sectional area in the corresponding first section 142. In the first embodiment, each of the indented sections 142*a* is realized by providing a projecting ring 16 inside the corresponding first section 142, wherein an area surrounded by an inner peripheral surface 16*a* of each of the projecting rings 16 is the minimum cross-sectional area of the corresponding first section 142.

Figure 6:
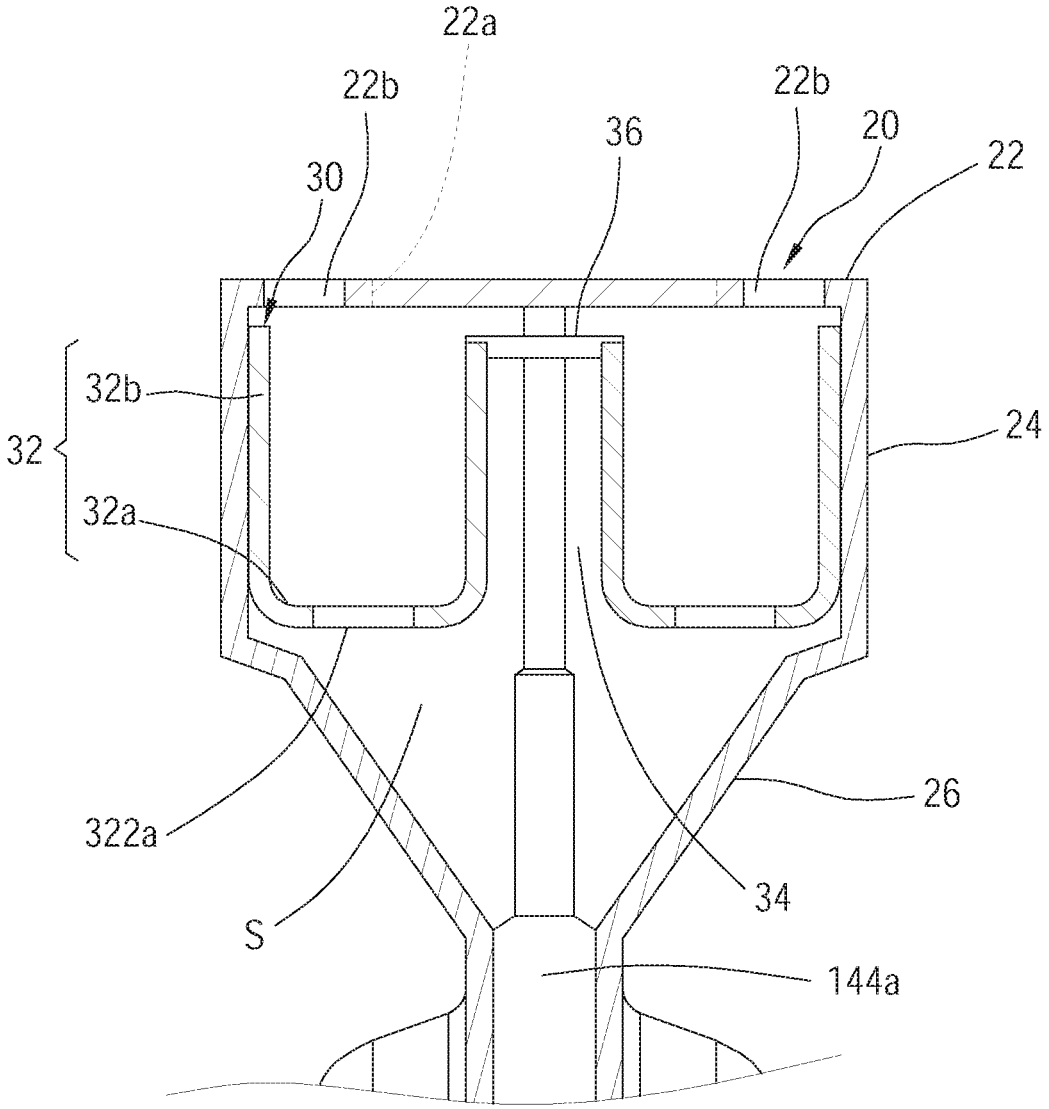
FIG. 6 is a sectional view along the 6-6 line in FIG. 3.

The combustion tray 20 is long in shape, and is provided on the base 10, wherein the combustion tray 20 includes a flame plate 22 located above the air passages 144*a* communicating with the second sections 144 of the horn-shaped tubes 14. The flame plate 22 has a plurality of first flame vents 22*a* arranged in a longitudinal direction of the combustion tray 20, wherein the first flame vents 22*a* communicate with the air passages 144*a*. Each of two lateral sides of the combustion tray 20 is formed by connecting a lateral plate 24 and an inclined plate 26, as illustrated in FIG. 6. The flame plate 22 of the combustion tray 20, the lateral plates 24, and the inclined plates 26 surround a chamber S. Each of the inclined plates 26 is engaged with a peripheral edge of one of the air passages 144*a*, wherein a distance between the inclined plates 26 gradually increases in a direction from the air passages 144*a* toward the lateral plates 24. The flame plate 22 further includes a plurality of second flame vents 22*b* evenly and correspondingly distributed on two opposite sides of the row of the first flame vents 22*a*, wherein the second flame vents 22*b* also communicate with the air passages 144*a*. In practice, the second flame vents 22*b* could be arranged on two sides of the row of the first flame vents 22*a* in a staggered way.

Figure 7:
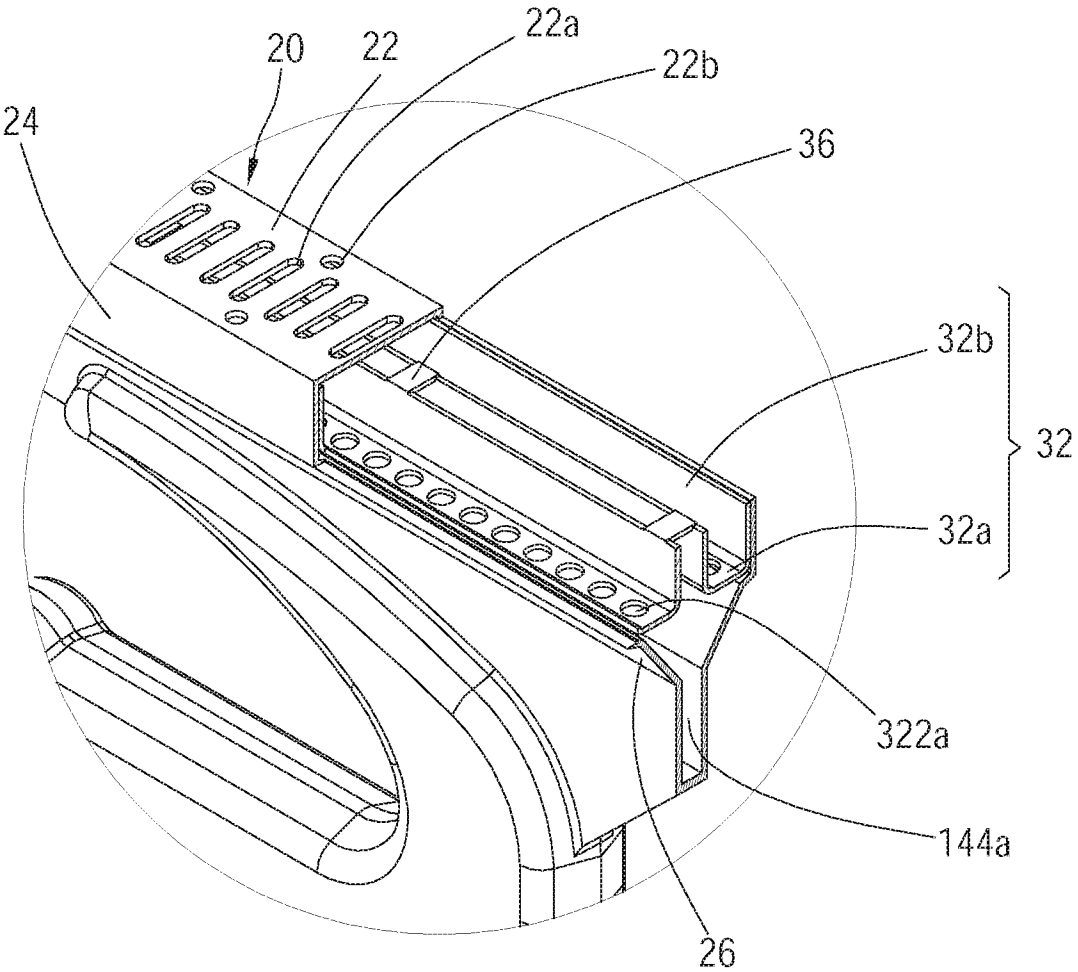
FIG. 7 is a partial sectional perspective view, showing part of the structure of the flow splitter.

As shown in FIG. 6 and FIG. 7, the flow splitter 30 is provided in the combustion tray 20 (i.e., located in the chamber S), wherein the flow splitter 30 includes two panels 32. Each of the panels 32 includes a bottom portion 32*a* and two lateral portions 32*b*. For each of the panels 32, the bottom portion 32*a* has a plurality of bores 322*a* provided thereon, and the lateral portions 32*b* are respectively connected to two lateral edges of the bottom portion 32*a* to substantially form a U-shape structure. One of the lateral portions 32*b* of one of the panels 32 is adjacent to one of the lateral portions 32*b* of the other one of the panels 32. A channel 34 is formed between said adjacent panels 32, wherein the channel 34 communicates with the bores 322*a*, the first flame vents 24, and the air passages 144*a* communicating with the second sections 144. The other one of the lateral portions 32*b* of each of the panels 32 respectively abuts against one of the lateral plates 24. The flow splitter 30 includes at least one connecting plate 36. In the first embodiment, the at least one connecting plate 36 includes a plurality of connecting plates 36 arranged at regular intervals in a longitudinal direction of the flow splitter 30, and each of the connecting plates 36 is connected to said adjacent lateral portions 32*b*.

With the aforementioned design, airflow containing gas and air could enter the burner through the inlet end 122. Since a cross-sectional area of the inlet pipe 12 first reduces toward the reduced section 126 and then increases, a velocity of the airflow would be increased while passing through the reduced section 126. Turbulence would be created once the airflow bumps into the closed end 124, which could further mix the gas and air before the airflow enters the first sections 142 through the lateral openings 128. Because the length of each of the first sections 142 is greater than or equal to the distance between the lateral openings 128 of the inlet pipe 12, there would be a sufficient distance to even further mix the gas and air. In addition, while the airflow is passing through the indented section 142*a* along a tube wall of each of the first sections 142 and hitting the corresponding projecting ring 16, turbulence would be also created around where the projecting ring 16 is, whereby to mix the gas and air again. After that, the airflow in each of the horn-shaped tubes 14 would pass through the projecting ring 16, the second section 144, the air passage 144*a*, and the flow splitter 30 in sequence, and then would be exhausted through the first flame vents 22*a* and the second flame vents 22*b*.

Figure 8:
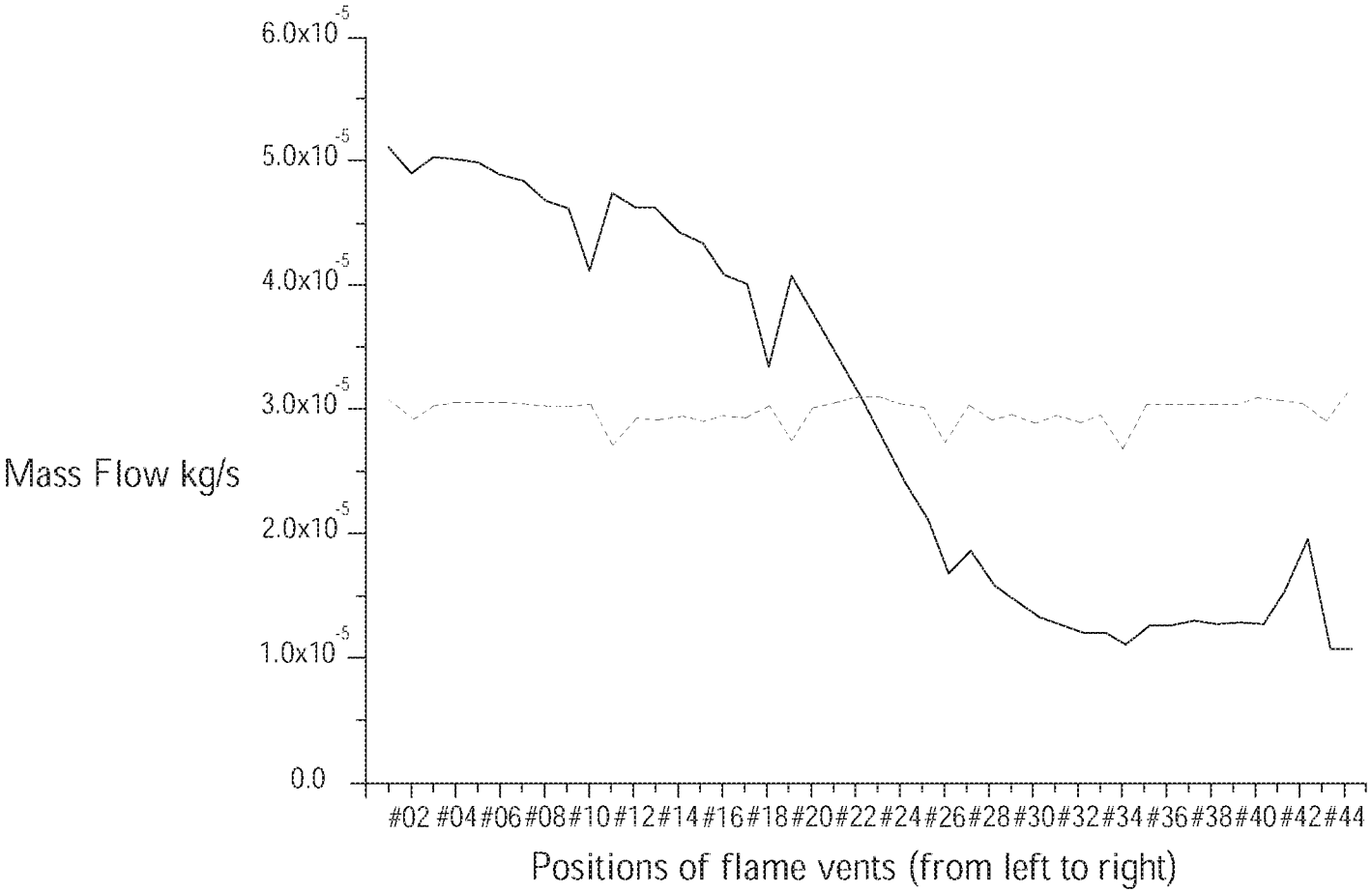
FIG. 8 is a relationship chart, showing the relationship between the mass flow and the positions of the flame vents of the first embodiment, in comparison with the relationship between the mass flow and the positions of the flame vents of the conventional burner.

A relationship between the mass flow and the positions of the first flame vents 22*a* of the burner 100 of the first embodiment is illustrated in FIG. 8, in comparison with the relationship between the mass flow and the positions of the flame vents 3*a* of the aforementioned conventional burner 1. The first flame vents 22*a* are numbered as 01-44 from left to right in sequence. A mass flow of airflow outputted from the first flame vents 22*a* of the burner 100 of the first embodiment (i.e., the dotted line shown in FIG. 8) distributes more evenly than that of the flame vents 3*a* of the conventional burner 1 (i.e., the solid line shown in FIG. 8). Therefore, the flame generated by the first flame vents 22*a* of the burner 100 of the first embodiment would be more even, and the heating efficiency could be enhanced as a result.

Figure 9:
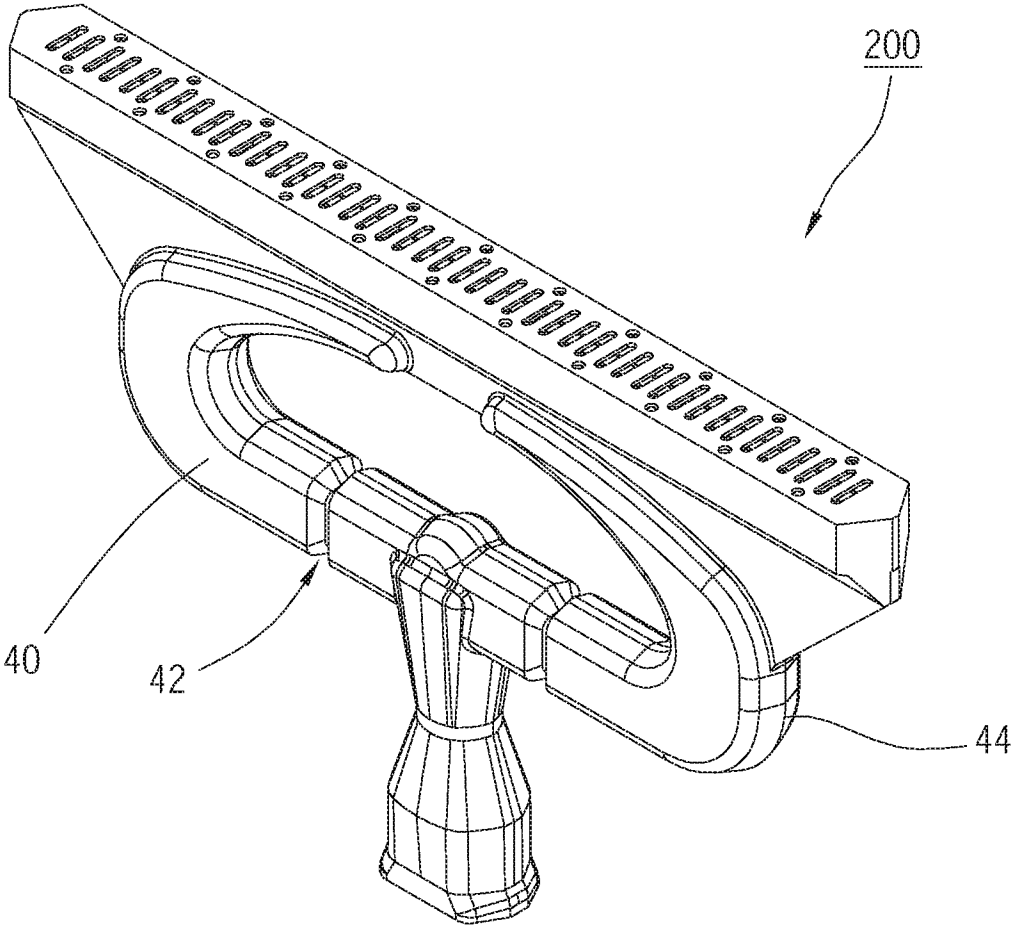
FIG. 9 is a perspective view of a second embodiment of the present invention.
Figure 10:
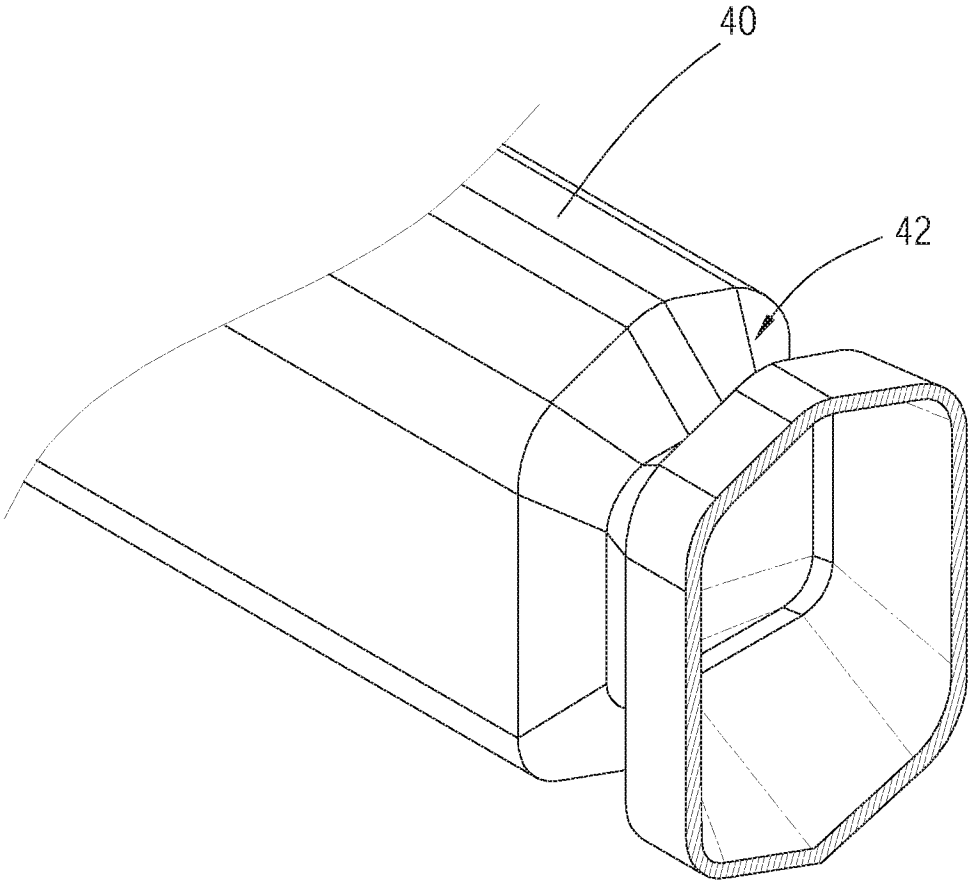
FIG. 10 is a partial sectional perspective view of FIG. 9.

A burner 200 of a second embodiment of the present invention is illustrated in FIG. 9 and FIG. 10, which has almost the same structure as the aforementioned first embodiment, except that an indented section 42 of each of first sections 40 of the second embodiment is formed by stamping. Furthermore, the base 44 is integrally made. Whereby, the burner 200 could be easily manufactured and assembled.

Figure 11:
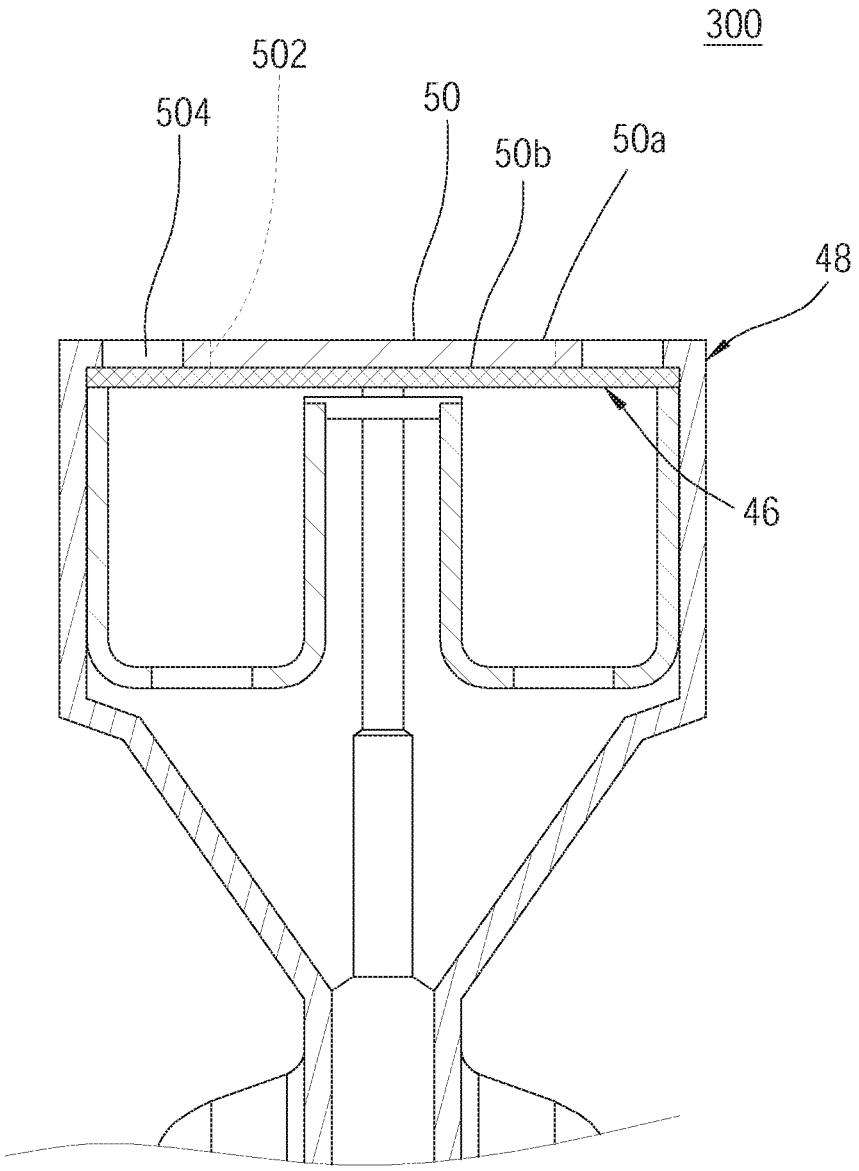
FIG. 11 is a partial sectional view of a third embodiment of the present invention.

A burner 300 of a third embodiment of the present invention is illustrated in FIG. 11, which has almost the same structure as the aforementioned first embodiment, except that the burner 300 further includes a metal mesh 46, which has a plurality of meshes. A flame plate 50 of a combustion tray 48 of the third embodiment has an inner surface 50*a* and an outer surface 50*b*, wherein first flame vents 502 and second flame vents 504 all go through the inner surface 50*a* and the outer surface 50*b*. The metal mesh 46 abuts against the inner surface 50*a*. A range of a projection of each of the first flame vents 502 and each of the second flame vents 504 covers a plurality of the meshes. A maximum diameter of the meshes of the metal mesh 32 is less than a minimum width of each of the first flame vents 502 and each of the second flame vents 504. The metal mesh 46 could regulate the airflow, making the flame which comes out from the first flame vents 502 and the second flame vents 504 become more even, whereby to prevent the flame created through the first flame vents 502 and the second flame vents 504 from splitting as resembling a fork.

Figure 12:
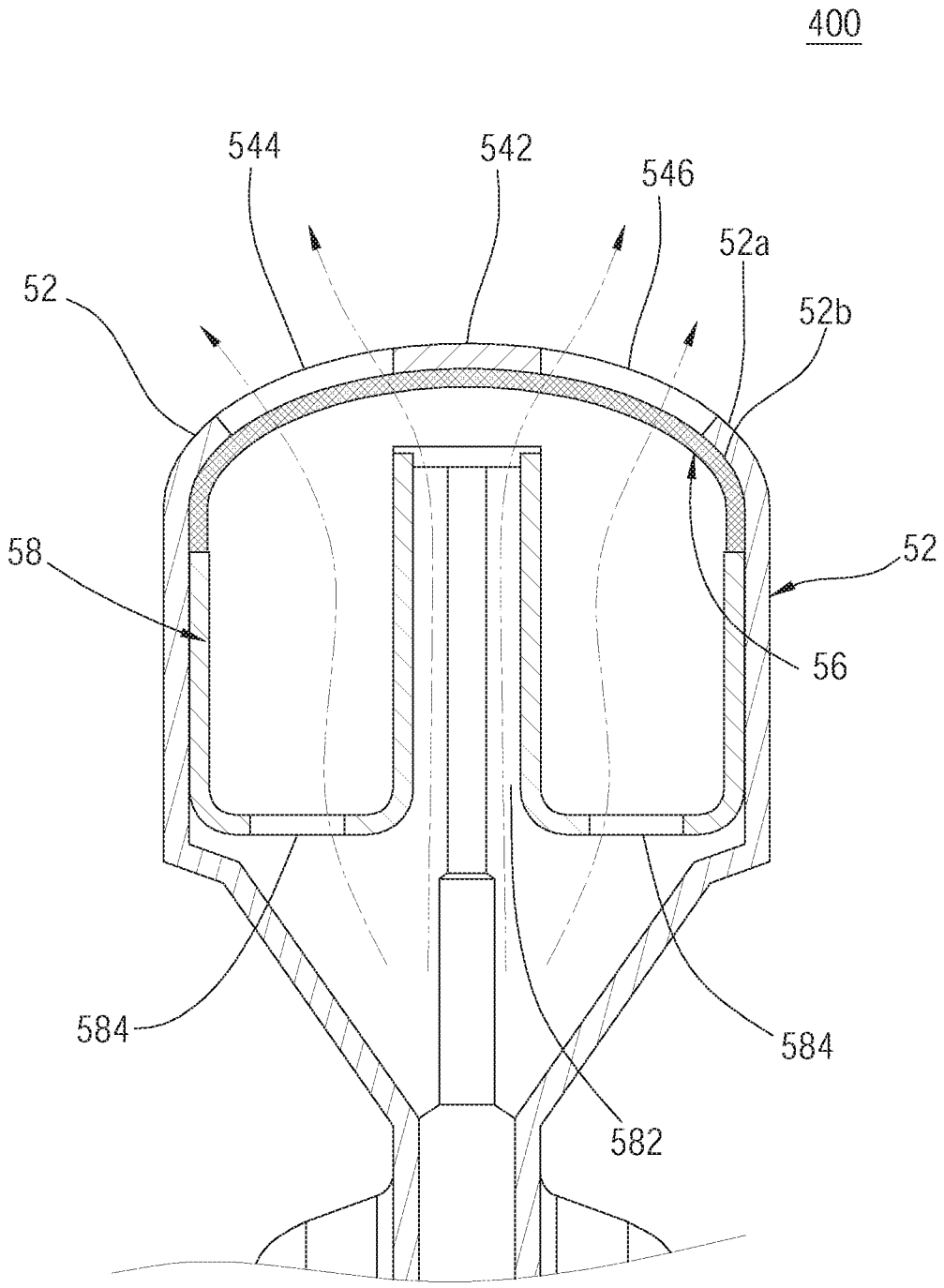
FIG. 12 is a partial sectional view of a fourth embodiment of the present invention.

A burner 400 of a fourth embodiment of the present invention is illustrated in FIG. 12, which has almost the same structure as the aforementioned second embodiment, except that a flame plate 54 of a combustion tray 52 of the fourth embodiment has a middle blocking portion 542 extending in a longitudinal direction of the combustion tray 52. The flame plate 54 of the combustion tray 52 bulges outward from an inner surface 54*a* toward an outer surface 54*b* thereof. A metal mesh 56 abuts against the inner surface 54*a*. In the fourth embodiment, each first flame vent 544 and each second flame vent 546 have the same size, wherein the first flame vents 544 and the second flame vents 546 are respectively located on two lateral sides of the middle blocking portion 542 in a transverse direction of the combustion tray 52. The first flame vents 544 and the second flame vents 546 are respectively arranged in the longitudinal direction of the combustion tray 52. In the fourth embodiment, a channel 582 of the flow splitter 58 is located directly below the middle blocking portion 542, and bores 584 of the flow splitter 58 are respectively located directly below the first flame vents 544 and the second flame vents 546. Whereby, the flame could be distributed on two lateral sides of the middle blocking portion 542, which spreads the flame of the whole combustion tray 52 outward in the transverse direction thereof. In practice, if the evenness of the flame coming out from the first flame vents 544 and the second flame vents 546 is taken out of consideration, then the metal mesh 56 could be omitted. In addition, the flame plate 54 could be designed as the shape shown in FIG. 11, which does not bulge outward.

In conclusion, the channels of each burner provided in the present invention are symmetrical, which transmits the airflow to the combustion tray in a more even way, whereby to generate a more uniform flame pattern. Furthermore, since the length of each of the first sections is greater than or equal to the distance between the lateral openings of the inlet pipe, gas and air could be mixed more evenly. In addition, the curved surface of the closed end of the inlet pipe and the indented section of each of the first sections would also facilitate the mixing of air and gas, whereby to enhance the heating efficiency.

It must be pointed out that the embodiments described above are only some preferred embodiments of the present invention. All equivalent structures which employ the concepts disclosed in this specification and the appended claims should fall within the scope of the present invention.

What is claimed is:

1. A burner, comprising:

a base, comprising:

an inlet pipe;

two horn-shaped tubes, each of which has a first section and a second section connected to the first section in a substantially perpendicular manner, wherein each of the first sections is connected to the inlet pipe; a length of each of the first sections is greater than or equal to an inner diameter of the inlet pipe where the first sections are connected to the inlet pipe; each of the second sections is bent to extend toward the other second section, and communicates with at least one air passage, wherein the air passage which communicates with one of the second sections also communicates with the air passage which communicates with the other one of the second sections;

a combustion tray provided on the base, wherein the combustion tray comprises a flame plate located above the air passages communicating with the second sections of the horn-shaped tubes; the flame plate has a plurality of first flame vents communicating with the air passages; and wherein the inlet pipe has an inlet end and a closed end, the closed end is located between the horn-shaped tubes, the inlet pipe has a curved surface recessed into an inner wall of the closed end, and the curved surface recesses in a direction toward the combustion tray.

2. The burner of claim 1, wherein a reduced section is provided between the inlet end and the closed end of the inlet pipe; the inlet pipe has two lateral openings located between the closed end and the reduced section, and each of the lateral openings respectively communicates with one of the first sections of the horn-shaped tubes.

3. The burner of claim 2, wherein a length of each of the first sections is greater than or equal to a distance between the lateral openings.

4. The burner of claim 1, wherein each of the first sections has an indented section; a cross-sectional area thereof is 70 percent to 80 percent of an average cross-sectional area of other portions of each of the first sections; the cross-sectional area of each of the indented sections is a minimum cross-sectional area in the corresponding first section.

5. The burner of claim 4, wherein the indented section of each of the first sections has a projecting ring; an area surrounded by an inner peripheral surface of each of the projecting rings is the minimum cross-sectional area of the corresponding first section.

6. The burner of claim 4, wherein each of the indented sections is formed by stamping.

7. The burner of claim 1, further comprises a metal mesh, which has a plurality of meshes, wherein the flame plate has an inner surface and an outer surface, wherein the first flame vents goes through the inner surface and the outer surface; the metal mesh abuts against the inner surface; a range of a projection of each of the first flame vents covers plurality of the meshes.

8. The burner of claim 1, further comprises a flow splitter provided in the combustion tray, wherein the combustion tray is long in shape, and has a longitudinal direction and a transverse direction; the flame plate has a middle blocking portion extending in the longitudinal direction of the combustion tray, and comprises a plurality of second flame vents; the first flame vents and the second flame vents are respectively located on two lateral sides of the middle blocking portion in the transverse direction, and are arranged in the longitudinal direction; the flow splitter has a channel and a plurality of bores, wherein the channel extends in the longitudinal direction of the combustion tray, and is located directly below the middle blocking portion; the bores are arranged in the longitudinal direction, and are distributed on two lateral sides of the channel.

9. The burner of claim 8, further comprises a metal mesh which has a plurality of meshes; the flame plate has an inner surface and an outer surface, wherein the first flame vents and the second flame vents go through the inner surface and the outer surface; the metal mesh abuts against the inner surface, and a range of a projection of each of the first flame vents and each of the second flame vents covers a plurality of the meshes.

10. The burner of claim 8, wherein the flame plate bulges outward from an inner surface toward an outer surface.

11. The burner of claim 1, wherein the flame plate further comprises a plurality of second flame vents distribute on opposite sides of a row of the first flame vents; the second flame vents communicate with the air passages.

* * * * *